US011666093B2

(12) United States Patent
Liu

(10) Patent No.: US 11,666,093 B2
(45) Date of Patent: Jun. 6, 2023

(54) ATOMIZER

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 372 days.

(21) Appl. No.: 17/029,088

(22) Filed: Sep. 23, 2020

(65) Prior Publication Data

US 2021/0235755 A1 Aug. 5, 2021

(30) Foreign Application Priority Data

Feb. 5, 2020 (CN) ..... 202010080224.3
Feb. 5, 2020 (CN) ..... 202020152285.1

(51) Int. Cl.
*A24F 40/42* (2020.01)
*A24F 40/485* (2020.01)
*A24F 40/10* (2020.01)

(52) U.S. Cl.
CPC ..... *A24F 40/42* (2020.01); *A24F 40/10* (2020.01); *A24F 40/485* (2020.01)

(58) Field of Classification Search
CPC ..... A24F 40/42; A24F 40/10; A24F 40/485; A24F 40/48
See application file for complete search history.

(56) References Cited

U.S. PATENT DOCUMENTS 10,986,874 B2 * 4/2021 Tucker ..... A24F 40/40

FOREIGN PATENT DOCUMENTS

CN 210672073 U * 6/2020
WO WO-2019157876 A1 * 8/2019
WO WO-2021062883 A1 * 4/2021 ..... A24F 40/10

* cited by examiner

*Primary Examiner* — Jean F Duverne
(74) *Attorney, Agent, or Firm* — Matthias Scholl P.C.; Matthias Scholl

(57) ABSTRACT

An atomizer, including an e-liquid tank, a connector, a silicone sleeve, and an atomization element. The connector is disposed in the e-liquid tank. The silicone sleeve is disposed around the connector. The atomization element is in threaded connection to the e-liquid tank. The atomization element includes atop end provided with an e-liquid inlet. The top end is disposed in the silicone sleeve whereby the e-liquid inlet is sealed; one end of the silicone sleeve extends out of the e-liquid tank. When the atomization element is short of e-liquid, lifting up the silicone sleeve to expose the e-liquid inlet, so as to inject the e-liquid into the atomization element.

6 Claims, 3 Drawing Sheets

ATOMIZER

CROSS-REFERENCE TO RELATED APPLICATIONS

Pursuant to 35 U.S.C. § 119 and the Paris Convention Treaty, this application claims foreign priority to Chinese Patent Application No. 202010080224.3 filed Feb. 5, 2020, and to Chinese Patent Application No. 202020152285.1 filed Feb. 5, 2020. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an atomizer.

Conventionally, the c-liquid is directly stored in the atomizer before and during use. There is a risk that the e-liquid may erode or oxidize the heating body. Thus, the quality of the e-liquid is adversely affected.

SUMMARY

The disclosure provides an atomizer, comprising an e-liquid tank, a connector, a silicone sleeve, and an atomization element. The connector is disposed in the e-liquid tank. The silicone sleeve is disposed around the connector. The atomization element is in threaded connection to the e-liquid tank. The atomization element comprises a top end provided with an e-liquid inlet. The top end is disposed in the silicone sleeve whereby the e-liquid inlet is sealed; one end of the silicone sleeve extends out of the e-liquid tank; when the atomization element is short of e-liquid, lifting up the silicone sleeve to expose the e-liquid inlet, so as to inject the e-liquid into the atomization element.

In a class of this embodiment, the atomizer further comprises a seal plug sealing a liquid-refilling inlet of the atomization element.

In a class of this embodiment, the atomizer further comprises a joint electrically connected to a bottom end of the atomization element.

In a class of this embodiment, the atomizer further comprises a steel casing disposed on a bottom end of the e-liquid tank to prevent thermal deformation of the e-liquid tank.

The following advantages are associated with the atomizer of the disclosure: the e-liquid inlet of the atomization element is sealed in the silicone sleeve. When in nonuse, the e-liquid stays out of the atomization element thus ensuring the quality of the e-liquid after a period of time of storage. The e-liquid is easily injected into the atomization element by lifting up the silicone sleeve.

DETAILED DESCRIPTION

To further illustrate, embodiments detailing an atomizer are described below. It should be noted that the following embodiments are intended to describe and not to limit the disclosure.

Figure 1:
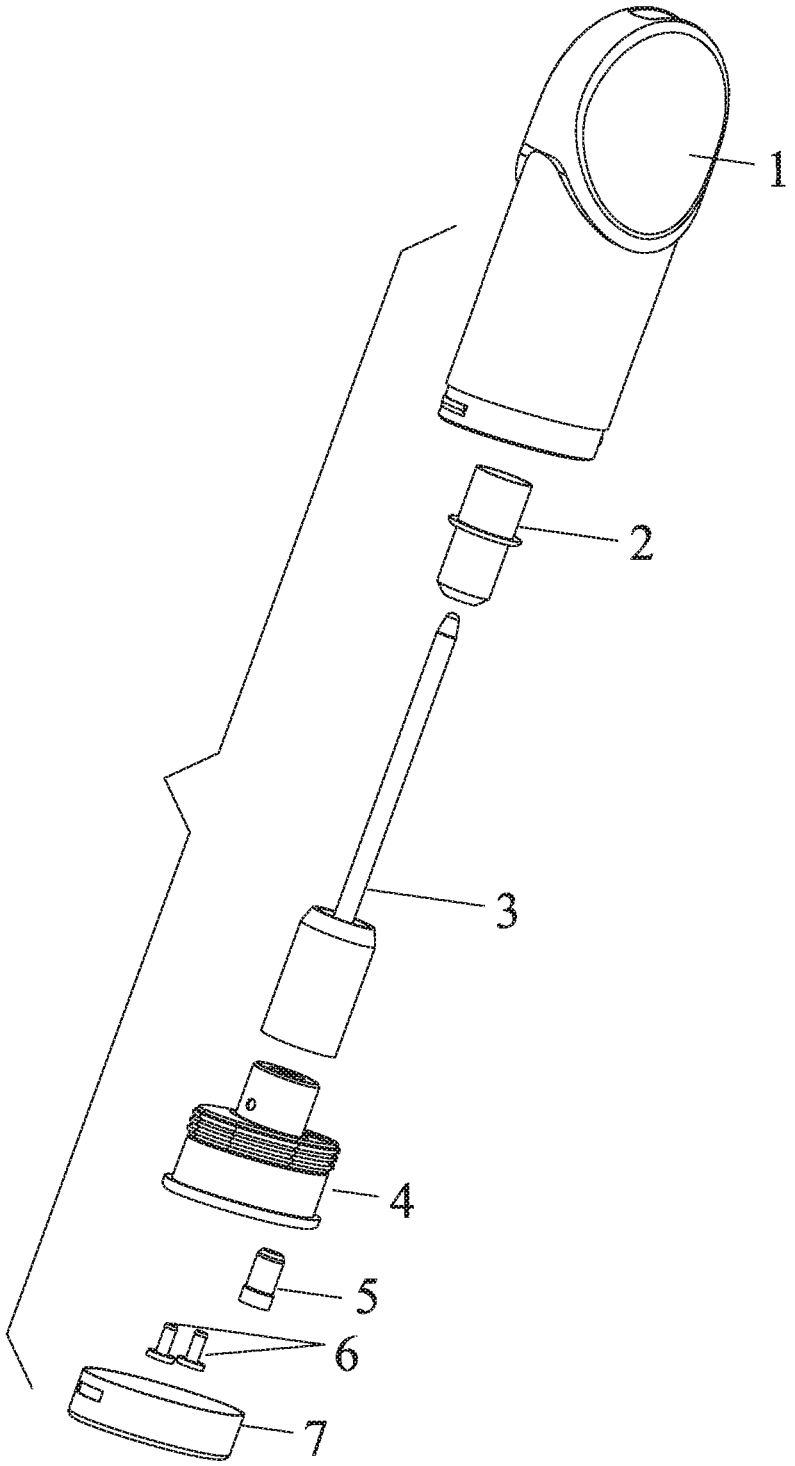
FIG. 1 is an exploded view of an atomizer according to one embodiment of the disclosure.
Figure 2:
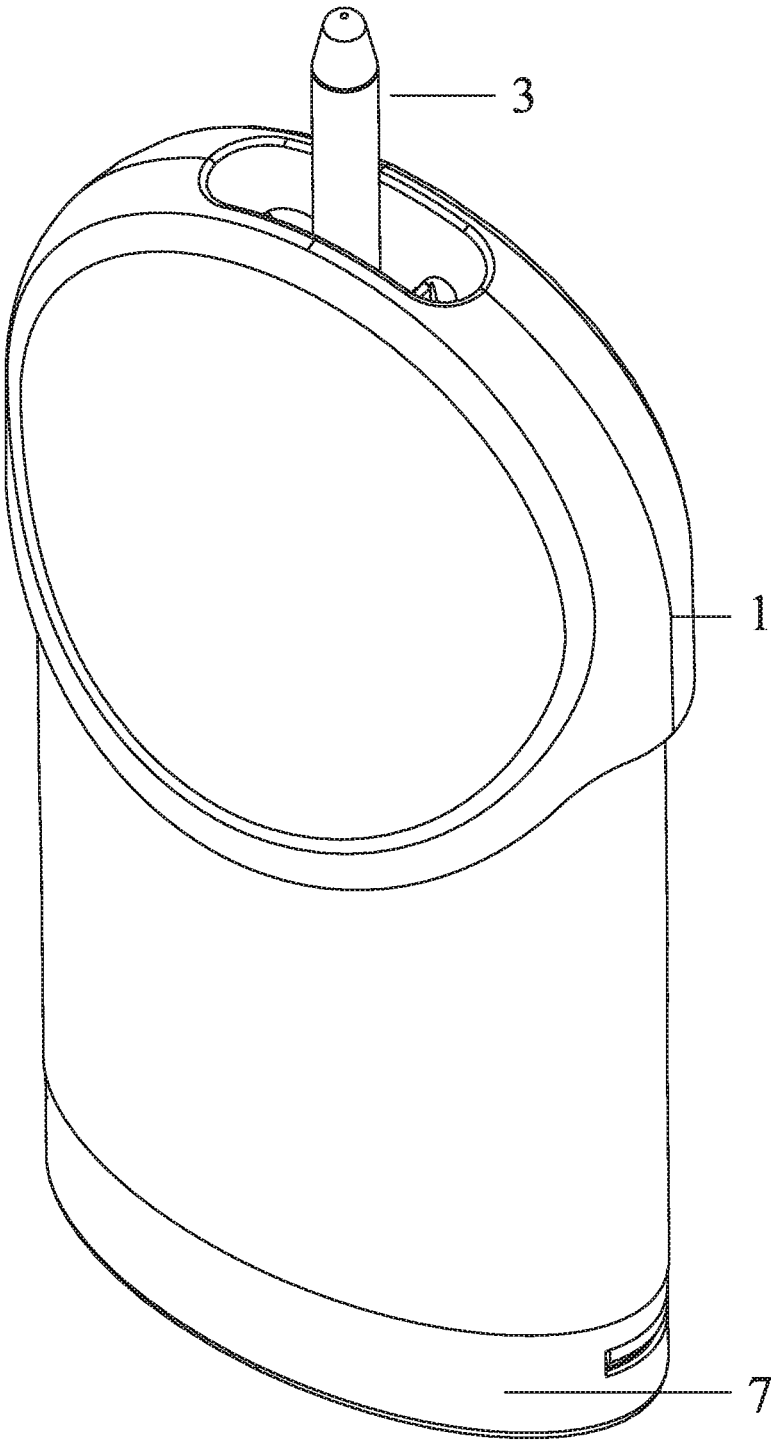
FIG. 2 is a schematic diagram of an atomizer according to another embodiment of the disclosure.
Figure 3:
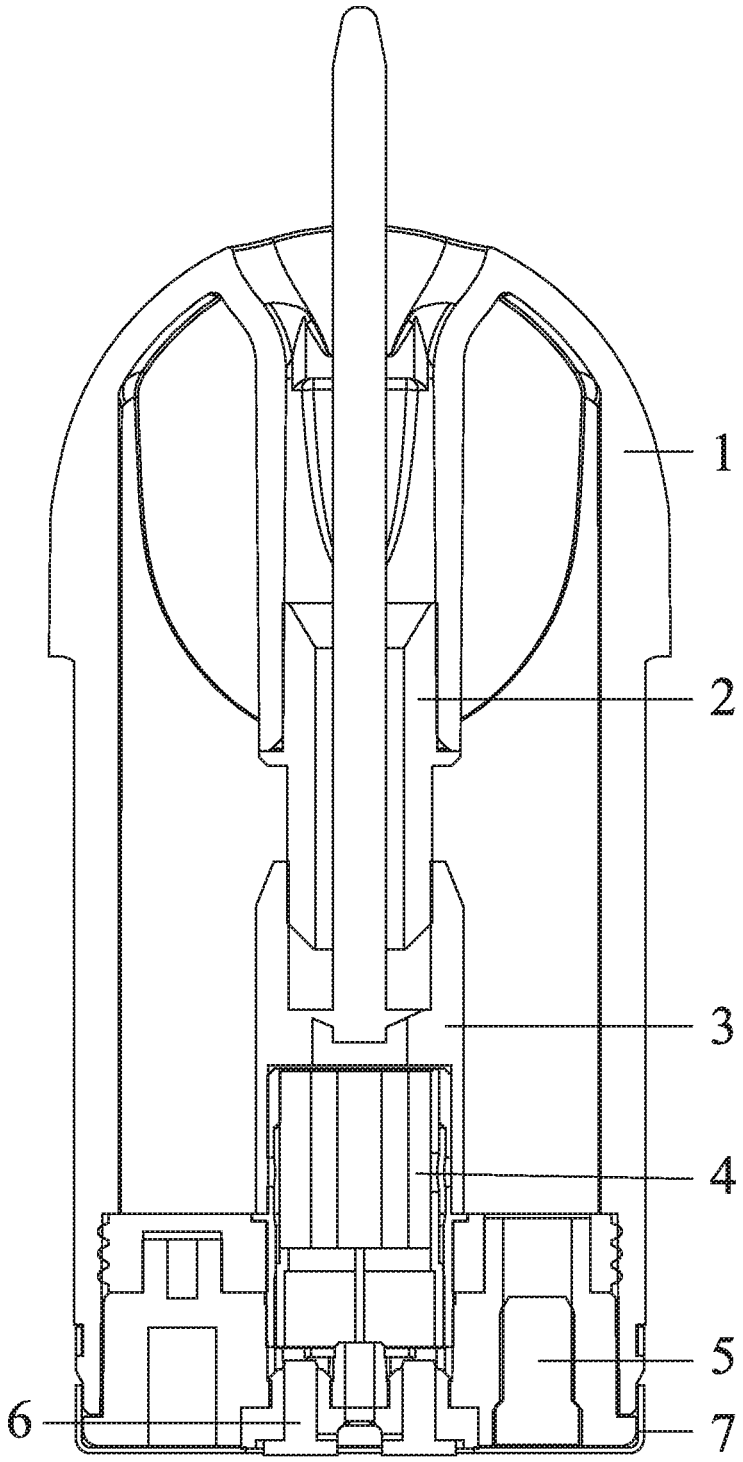
FIG. 3 is a sectional view of an atomizer according to one embodiment of the disclosure.

As shown in FIGS. 1-3, an atomizer comprises an e-liquid tank 1, a connector 2, a silicone sleeve 3, an atomization element 4, a seal plug 5, a joint 6, and a steel casing 7. The connector 2 is disposed in the e-liquid tank 1. The silicone sleeve 3 is disposed around the connector 2. The atomization element 4 is in threaded connection to the e-liquid tank 1. The atomization element 4 comprises a top end provided with an e-liquid inlet. The top end is disposed in the silicone sleeve 3 whereby the e-liquid inlet is sealed. The seal plug 5 is disposed in a liquid-refilling inlet of the atomization element 4 to seal the liquid-refilling inlet. The joint 6 is electrically connected to the bottom end of the atomization element 4 for electric conduction. The steel casing 7 is disposed on the bottom end of the e-liquid tank 1 to prevent thermal deformation of the e-liquid tank 1. One end of the silicone sleeve 3 extends out of the e-liquid tank 1; when the atomization element 4 is short of e-liquid, lifting up the one end of the silicone sleeve 3 to expose the e-liquid inlet, so as to inject the e-liquid into the atomization element 4.

The following advantages are associated with the atomizer of the disclosure:

1. The atomization element is separated from the c-liquid tank. When in nonuse, the e-liquid stays out of the atomization element thus ensuring the quality of the e-liquid after a period of time of storage.

2. The e-liquid is easily injected into the atomization element by lifting up the silicone sleeve.

It will be obvious to those skilled in the art that changes and modifications may be made, and therefore, the aim in the appended claims is to cover all such changes and modifications.

What is claimed is:

1. An atomizer, comprising:

an e-liquid tank having a chamber for storing an e-liquid, the e-liquid tank comprising a top tank end and bottom tank end;

a connector, the connector comprising a top connector end and a bottom connector end;

a silicone sleeve, the silicone sleeve comprising a top sleeve end and a bottom sleeve end; and an atomization element for vaporizing the e-liquid to produce vapor, the atomization element comprising a top atomization end and a bottom atomization end;

wherein:

the connector is disposed in the e-liquid tank, and top connector end abuts against the top tank end;

the top sleeve end comprises a guide portion, the guide portion is disposed around and slidable along the outer surface of the bottom connector end;

the atomization element is in threaded connection to the e-liquid tank;

the top atomization end is provided with an e-liquid inlet, the e-liquid inlet is adapted to convey the e-liquid from the chamber of the e-liquid tank into the atomization element to be vaporized;

the top atomization end is disposed within the bottom sleeve end, and the bottom sleeve end is adapted to seal the e-liquid inlet from the chamber of the e-liquid tank;

the top sleeve end comprises a tube portion, the tube portion comprises a passage for conveying vapor, and the tube portion extends through the connector and out of the e-liquid tank; and the tube portion is adapted to move up or down the silicone sleeve with respect to the atomization element, whereby the e-liquid inlet is exposed to or sealed from the chamber of the e-liquid tank.

2. The atomizer of claim 1, further comprising a liquid-refilling inlet on the bottom atomization end, and a seal plug for sealing the liquid-refilling inlet.

3. The atomizer of claim 1, further comprising a joint electrically connected to the bottom atomization end.

4. The atomizer of claim 2, further comprising a joint electrically connected to the bottom atomization end.

5. The atomizer of claim 1, further comprising a steel casing disposed on the bottom tank end to prevent thermal deformation of the e-liquid tank.

6. The atomizer of claim 2, further comprising a steel casing disposed on the bottom tank end to prevent thermal deformation of the e-liquid tank.

* * * * *